US008381562B2

(12) United States Patent
Schroth et al.

(10) Patent No.: US 8,381,562 B2
(45) Date of Patent: Feb. 26, 2013

(54) METAL FORMING APPARATUS CHARACTERIZED BY RAPID COOLING AND METHOD OF USE THEREOF

(75) Inventors: James G. Schroth, Troy, MI (US); Richard H. Hammar, Utica, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1213 days.

(21) Appl. No.: 11/671,493

(22) Filed: Feb. 6, 2007

(65) Prior Publication Data

US 2008/0184763 A1 Aug. 7, 2008

(51) Int. Cl.
*B21D 37/16* (2006.01)

(52) U.S. Cl. ..... 72/342.1

(58) Field of Classification Search ..... 72/57, 60, 72/342.1, 342.2, 342.3, 342.5
See application file for complete search history.

(56) References Cited

U.S. PATENT DOCUMENTS

| | | | | |
|---|---|---|---|---|
| 4,056,949 | A * | 11/1977 | Hahn | 62/373 |
| 4,793,172 | A * | 12/1988 | Eibe | 72/200 |
| 5,974,847 | A | 11/1999 | Saunders et al. | |
| 6,253,588 | B1 | 7/2001 | Rashid et al. | |
| 6,334,481 | B1 * | 1/2002 | Chen | 165/80.3 |
| 6,810,709 | B2 * | 11/2004 | Hammar et al. | 72/342.7 |
| 2004/0083784 | A1 * | 5/2004 | Kim et al. | 72/57 |

* cited by examiner

*Primary Examiner* — Teresa M Ekiert
(74) *Attorney, Agent, or Firm* — Quinn Law Group, PLLC

(57) ABSTRACT

A metal forming apparatus characterized by rapid cooling includes a forming tool having a first portion defining a forming surface and a second portion defining a cavity for a working gas. A plurality of fins are in conductive heat transfer relationship with the forming tool. The metal forming apparatus enables a high thermal efficiency mode of operation when the effect of the fins is negated for use during metal forming operation, and a rapid cooling mode for use in preparing for tool maintenance. A corresponding method is also provided.

14 Claims, 2 Drawing Sheets

METAL FORMING APPARATUS CHARACTERIZED BY RAPID COOLING AND METHOD OF USE THEREOF

TECHNICAL FIELD

This invention relates to metal forming apparatuses that include a metal forming tool and fins in conductive heat transfer relationship with the tool.

BACKGROUND OF THE INVENTION

Metal forming tools used in superplastic forming (SPF) and quick plastic forming (QPF) typically include a first portion that defines a gas pressure chamber and a second portion that defines a forming surface. During operation of an SPF or QPF forming tool, a metal blank is placed between the first and second portions of the forming tool such that a first side of the blank is in fluid communication with the chamber and a second side of the blank faces the forming surface. Fluid pressure is introduced into the chamber, which acts on the first side of the metal blank, causing the blank to deform so that the second side contacts, and assumes the shape of, the forming surface.

The tool is heated so that the metal blank is maintained at a temperature sufficient for plastic deformation at the forming pressure, typically between 825° F. and 950° F. It is therefore desirable for the tool to be configured for minimal heat transfer to the surrounding environment in order to minimize the amount of energy required to maintain the tool at the desired temperature and the costs associated therewith. Accordingly, the prior art teaches thermally efficient forming tools to reduce heat loss to the environment.

Maintenance of prior art tools must often be performed after several hundred forming cycles. Such maintenance may include removing aluminum buildup on critical forming surfaces. However, prior art tools often take a significant amount of time to cool from their elevated operating temperatures of greater than 800° F. to a temperature suitable for maintenance, such as less than 110° F. For example, some prior art tools require approximately eighteen hours to cool to a sufficiently low temperature for maintenance, during which time the tool is unproductive.

SUMMARY OF THE INVENTION

A metal forming apparatus includes a forming tool having a first portion defining a forming surface and a second portion defining a gas pressure chamber. A plurality of fins are in conductive beat transfer relationship with the forming tool. The metal forming apparatus enables rapid heat loss to the surrounding environment because the fins provide increased surface area for heat transfer to a cooling fluid such as air. Thus, the metal forming apparatus reduces the amount of time required to cool the tool from its operating temperature to a temperature at which tool maintenance can be performed compared to the prior art. Accordingly, the metal forming apparatus enables increased tool productivity compared to the prior art by significantly reducing the amount of time required to perform tool maintenance.

The metal forming apparatus may also enable two modes of tool operation, namely a rapid cooling mode for use when preparing the tool for maintenance, and a thermally efficient mode for use during metal forming operation. The rapid cooling mode is achieved when the fins are exposed to the cooling fluid for convective heat transfer to the surrounding environment.

The thermally efficient mode is achieved when the effect of the fins is minimized or negated by restricting flow of the cooling fluid currents across the fins. In an exemplary embodiment, a member is mountable with respect to the tool to at least partially enclose the fins, thereby minimizing the effect of the fins by restricting the flow of the cooling fluid to the fins. Accordingly, the member acts to inhibit convective heat transfer and therefore provides a higher thermal efficiency for efficient metal forming operation. Preferably, the member comprises an insulating material to further reduce heat transfer from the fins and from the forming tool, thereby further enhancing the thermal efficiency of the tool.

A corresponding method is also provided. The method includes providing a metal forming tool having a plurality of fins operatively connected thereto, providing a restriction to fluid flow to or from the fins, and heating the forming tool. The method further includes, subsequent to heating the forming tool, removing the restriction to fluid flow to or from the fins.

The above features and advantages, and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
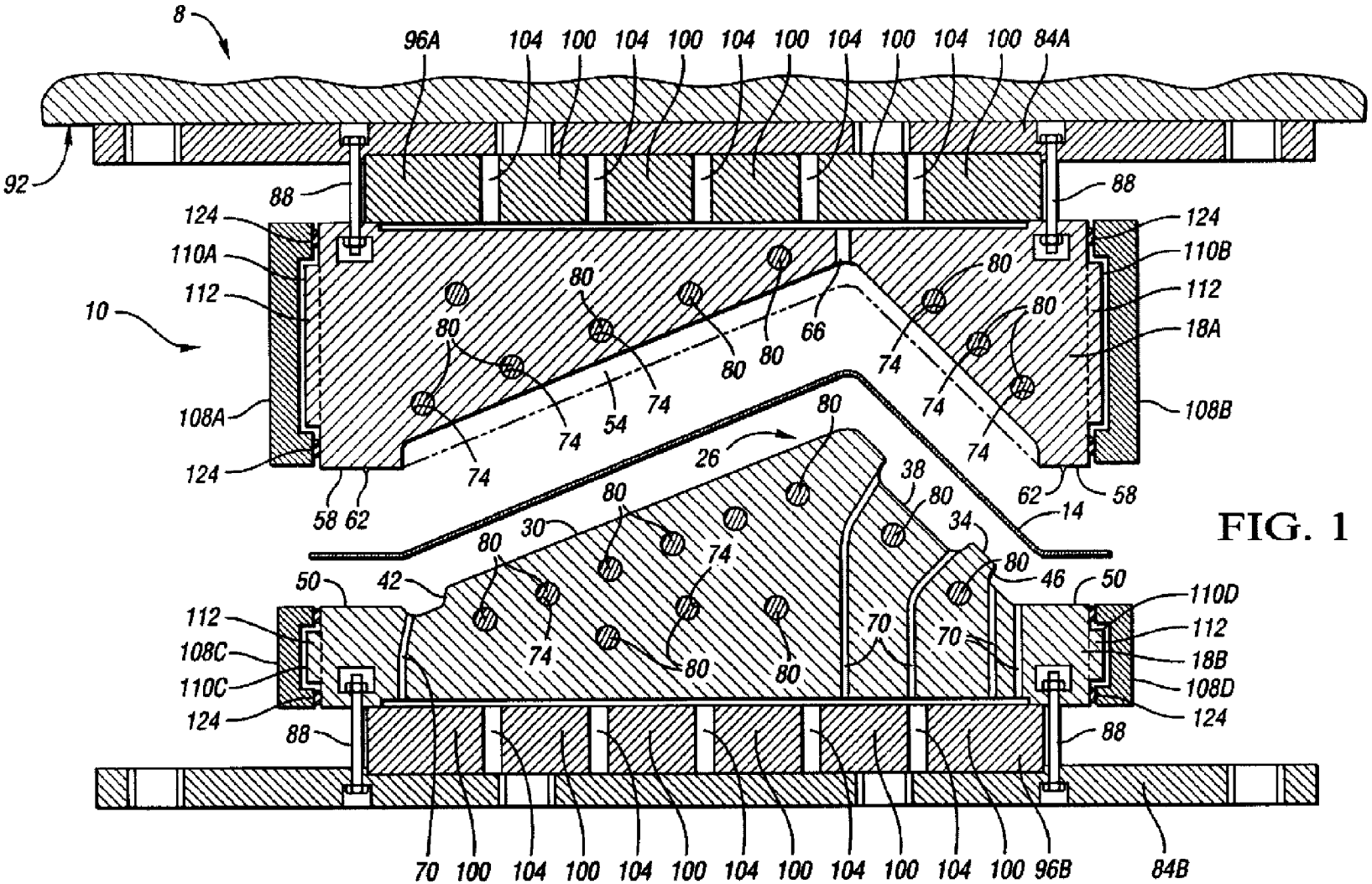
FIG. 1 is a schematic, cross-sectional side view taken about a vertical plane of a metal forming apparatus including a metal forming tool.

Referring to FIG. 1, a metal forming apparatus 8 is schematically depicted. The metal forming apparatus 8 includes a metal forming tool 10 for stretch forming a metal blank 14. The forming tool 10 includes an upper portion 18A and a lower portion 18B. The forming tool 10 depicted is configured to form the blank 14 into a decklid outer panel (not shown); however, a forming tool may be configured to form a blank or other metal piece into any form within the scope of the claimed invention. The blank 14 is depicted with bends or curves; however, those skilled in the art will recognize that other blank configurations may be employed. The blank 14 is formed from a flat, cleaned and lubricated sheet blank that is heated with a preheater (not shown) that heats the blank to a suitable forming temperature.

The lower portion 18B defines a complex forming surface 26 that defines the back side of the decklid outer panel. The forming surface 26 includes a forming surface portion 30 that defines a horizontal portion of the decklid. Another portion 34 of the forming surface 26 forms a vertical portion of the decklid. Still another portion 38 of the forming surface 26 forms a license plate recess. Other portions 42, 46 of the forming surface 26 form flanges at the forward edge of the horizontal portion of the decklid and the bottom of the vertical portion. The periphery 50 of the lower portion 18B has a surface for clamping and sealing the peripheral portion of the blank 14.

The upper portion 18A is complementary in shape to the lower portion 18B and is provided with a shallow cavity 54 that forms a chamber for the introduction of a high pressure working gas, e.g., air, nitrogen or argon, against the back side of the blank 14. The periphery 58 of the upper portion 18A incorporates a sealing bead 62 that is adapted to engage the perimeter of the blank 14 and to seal against working gas pressure loss when the upper portion 18A is closed against the blank 14 and lower portion 18B. The upper portion 18A also includes a working gas inlet 66 to admit fluid pressure to the chamber 54 and against the back side of the blank 14.

The lower portion 18B defines a plurality of passageways 70 that extend from the forming surface 26 to an exhaust port (not shown) to enable air or other entrapped gas to escape from below the blank 14 so that the blank can subsequently be stretched into strict conformance with the shaping surface 26 of the lower portion 18B of the forming tool 10.

The upper and lower portions 18A, 18B define holes 74 in which heating elements 80 are disposed. In the embodiment depicted, the holes 74 are bores formed through the tool portions 18A, 18B. The heating elements 80 are preferably electrical resistance heating elements, and are provided to maintain the tool 10 at the desired operating temperature of about 825° F. to 950° F. The placement of the heating elements is preferably configured to ensure uniformity of the temperature throughout the tool 10 to prevent warping during tool heat-up and at the operating temperature. It should be noted that the heating elements 80 preferably contact the entire circumference of the holes 74 in order to maximize heat transfer from the heating elements 80 to the tool 10.

The forming tool 10 is preferably constructed of a solid material to maximize the heat transfer from the plurality of heating elements 80 through the forming tool 10. The forming tool 10 may be constructed of a tool grade steel that exhibits durability at the forming temperatures of a superplastic or quick plastic forming operation. Preferably, the forming tool detail is constructed of AISI P20 steel that is readily available in large billets to accommodate a large forming tool. The initial forged steel billet is machined to form a curved detail specific to the part being produced by the heated metal forming tool 10. AISI P20 steel may be readily weld repaired and refinished, as opposed to higher carbon material compositions, which are more difficult to weld repair and refinish.

The upper portion 18A is attached to an upper mounting plate 84A with fasteners 88. The lower portion 18B is attached to a lower mounting plate 84B with fasteners 88. The upper mounting plate 84A is attached to a press 92 for selectively opening and closing the metal forming tool 10, i.e., for selectively moving the upper portion 18A between open and closed positions with respect to the lower portion 18B of the forming tool 10. The mounting plates 84A, 84B are preferably formed of plate steels, such as ASTM A36 steel, or AISI P20 steel, depending on the load carrying requirements. The fasteners 88 are preferably formed of heat resistant alloys, such as RA330 or other suitable heat resistant and load bearing alloys.

The metal forming apparatus 8 includes insulation to minimize heat loss from the tool 10, and thereby minimize the energy supplied to the heating elements 80 in order to maintain the tool 10 at elevated operating temperatures. Load-face insulation 96A is positioned between the upper portion 18A of the tool 10 and the upper mounting plate 84A. The load-face insulation 96A includes a combination of load bearing insulation members 104 and non-load bearing insulation 100. The load bearing insulation members 104 of load-face insulation 96A are spaced from each other, and each of the members 104 of load-face insulation 96A contacts the upper mounting plate 84A and the upper portion 18A of the tool 10 to transfer loads therebetween. Non-load bearing insulation 100 fills the spaces between the load bearing insulation members 104 of load-face insulation 96A.

Similarly, load-face insulation 96B is positioned between the lower portion 18B of the tool 10 and the lower mounting plate 84B. The load-face insulation 96B includes a combination of load bearing insulation members 104 and non-load bearing insulation 100. The load bearing insulation members 104 of load-face insulation 96B are spaced from each other, and each of the members 104 of load-face insulation 96B contacts the lower mounting plate 84B and the lower portion 18B of the tool 10 to transfer loads therebetween. Non-load bearing insulation 100 fills the spaces between the load bearing insulation members 104 of load-face insulation 96B.

Those skilled in the art will recognize a variety of materials that may be used to form the load bearing insulation members 104, such as high load bearing ceramics, high load bearing composites, INCONEL alloys, and various austenitic steels. In a preferred embodiment, the load bearing insulation members 104 are austenitic steel posts. The non-load bearing insulation is preferably a blanket insulation that is capable of withstanding the elevated temperature of the forming tool. Those skilled in the art will recognize a variety of materials that may be used to form the non-load bearing insulation 100 within the scope of the claimed invention. An exemplary blanket insulation is Cer-wool RT commercially available from Vesuvius, USA. The load-face insulation 96A, 96B isolates the high-temperature forming tool portions 18A, 18B from the mounting plates 84A, 84B to maintain a high temperature within the forming tool 10, as well as to maintain a lower ambient temperature on the outside of the forming tool 10.

The metal forming apparatus 8 also includes insulation surrounding its periphery. More specifically, insulating members 108A-D are attached to the tool 10 to cover a respective vertical peripheral surface 110A-D of the tool.

Figure 2:
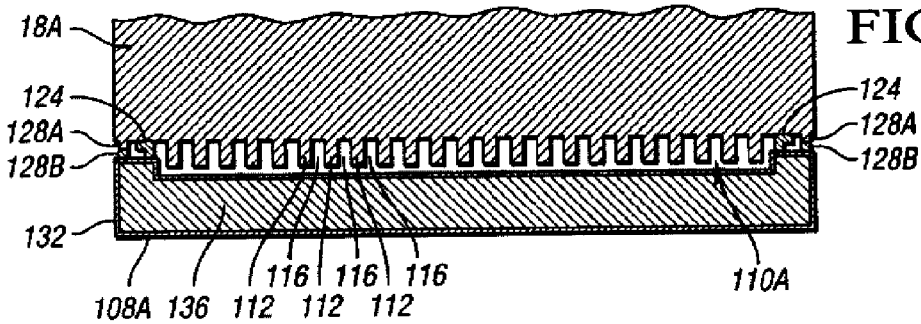
FIG. 2 is a schematic, cross sectional view of a portion of the metal forming tool of FIG. 1 taken about a horizontal plane.

The apparatus 8 includes a plurality of fins 112 in conductive heat transfer relationship with the metal forming tool 10. More specifically, each of the upper and lower portions 18A, 18B of the forming tool 10 has fins 112 operatively connected thereto and at least partially forming surfaces 110A-D. FIG. 2 schematically depicts surface 110A of the upper portion 18A of the tool 10, and insulating member 108A. It should be noted that the configurations of surface 110A and member 108A are representative of the configurations of surfaces 110B-D and members 108B-D, although the surfaces 110B-D and members 108B-D are differently dimensioned than surface 110A and member 108A.

Referring to FIG. 2, wherein like reference numbers refer to like components from FIG. 1, the cooling fins 112 in the embodiment depicted are vertically oriented, parallel with one another, and are spaced apart from one another to form a plurality of vertically oriented channels 116 therebetween. Those skilled in the art will recognize a variety of fin configurations that may be employed within the scope of the claimed invention. For example, although the fins 112 are depicted as having a rectangular cross section, other cross sectional fin shapes may be employed within the scope of the claimed invention, such as triangular, semicircular, sinusoidal, etc. Similarly, fins 112 may be characterized by various lengths, thicknesses, amount of protuberance, etc. Further, vertical orientation of the fins as shown may provide maximum natural convection, but other orientations may be used within the scope of the claimed invention. For example, any fin orientation will be effective, particularly with forced convection.

In the embodiment depicted, the fins 112 are formed in the tool portion 118B as part of a one-piece member. However, within the scope of the claimed invention, the fins may be one or more separate pieces attached to the tool in conductive heat transfer relationship therewith, i.e., such that heat from the tool is conductable, through solid material, from the tool to the fins. It may, for example, be desirable for the fins to be comprised of a high-conductivity metal (e.g., a metal having conductivity higher than the material of the tool 10). The fins 112 depicted in FIG. 2 are in conductive heat transfer relationship with tool portion 18A.

Fastening elements 128A are mounted with respect to the tool portion 18A. Corresponding fastening elements 128B are mounted with respect to the member 108A. Each of the fastening elements 128B is engageable with a respective one of fastening elements 128A to secure the member 108A to the tool portion 18A, as shown in FIGS. 1 and 2. Those skilled in the art will recognize a variety of fastening elements that may be employed within the scope of the claimed invention, including slot and key arrangements, latches, threaded fasteners and holes, etc.

Figure 3:
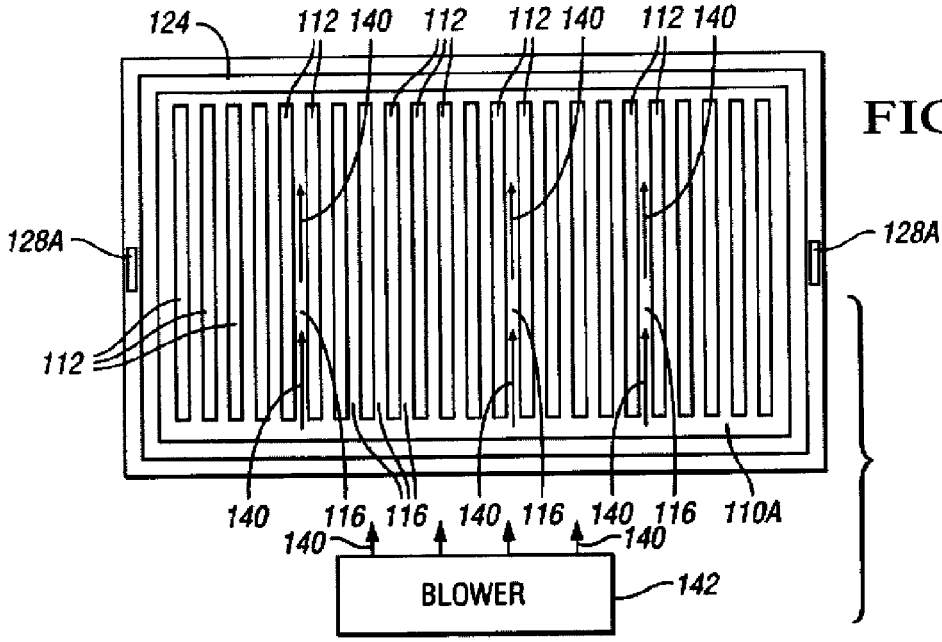
FIG. 3 is a schematic side view of a face of the metal forming tool of FIG. 1.

Member 108A cooperates with the tool portion 18A to enclose the fins 112 that are on surface 110A. Referring to FIG. 3, wherein like reference numbers refer to like components from FIGS. 1 and 2, a seal 124 is mounted to the tool portion 18A to circumscribe the plurality of fins 112 that are at surface 110A. Referring again to FIG. 2, member 108A contacts seal 124 so that the seal 124 cooperates with the member 108A and the tool portion 18A to enclose the fins 112 that are at surface 110A. In the embodiment depicted, member 108A cooperates with the seal 124 and the tool portion 18A so that the fins 112 on surface 110A are fully enclosed.

Referring to FIGS. 1 and 2, members 108B-D likewise cooperate with respective seals 124 to fully enclose the fins 112 of surfaces 110B-D, respectively. When the members 108A-D are secured as shown to the tool portions 18A, 18B, the members 108A-D act as restrictions to air flow across, i.e., to or from, the fins 112, and a thermally efficient mode of tool operation is thereby achieved. By enclosing the fins 112, members 108A-D negate the effect of the fins 112 on the transfer of heat from the tool 10 to the surrounding environment. More specifically, in the thermally efficient mode of tool operation, the members 108A-D obstruct air flow across, i.e., to or from, the fins 112, thereby negating any increase in convective heat transfer that the fins 112 would provide if exposed to air currents. Furthermore, the members 108A-D include an insulating material (shown at 136 in FIG. 2) having a low thermal conductivity, preferably significantly lower than the thermal conductivity of the fins 112, encased in a cover (shown at 132 in FIG. 2), to reduce conductive heat transfer from the tool 10 to the surrounding environment.

After heating the tool 10 by the heating elements 80, blanks 14 may be formed against surface 26, as understood by those skilled in the art. After a predetermined operating time, or after a predetermined quantity of blanks being formed, it may be desirable to perform maintenance on the tool 10. However, the tool 10 must first be cooled from its operating temperature prior to performing maintenance. A rapid tool cooling mode is achievable by detaching members 108A-D from the tool 10.

Fastening elements 128A are selectively releasable from corresponding complimentary fastening elements 128B so that members 108A-D are detachable from the tool 10 to expose the fins 112. Referring to FIG. 3, wherein like reference numbers refer to like components from FIGS. 1 and 2, surface 110A of the upper portion 18A of tool 10 is shown with member 108A removed so that the fins 112 are exposed. Currents of air 140 may be produced naturally by convection when the members 108A-D are removed: air 140 heated by the fins 112 rises, thereby drawing cooler air 140 to the fins 112. Currents of air 140 may also be forced such as by a fan 142. Increasing the surface area provided by the fins 112, for example, by increasing the distance that the fins extend outward from the tool 10 or by increasing the quantity of fins, will result in shorter cooling times. In exemplary embodiments, the fins 112 provide two or three times the surface area where the fins 112 are present compared to a flat surface. It should be noted that, although the fan 142 is schematically depicted below the tool 10, it is preferable to orient the fan 142 such that the air travels from the fan 142 to the fins 112 perpendicular to the orientation of the tool surface 110A.

Figure 4:
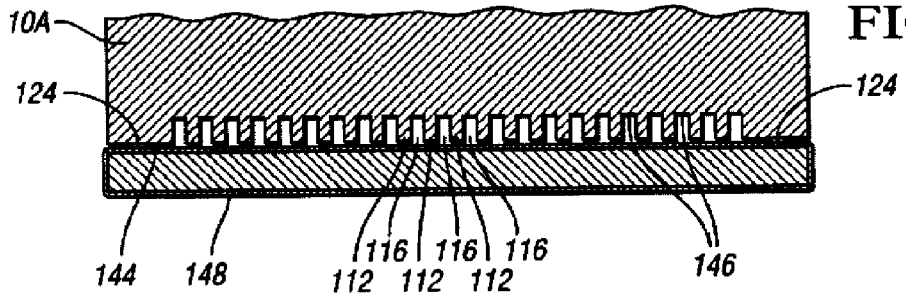
FIG. 4 is a schematic, cross-sectional view of an alternative metal forming tool in accordance with the claimed invention.

FIG. 4 schematically depicts an alternative tool configuration. Referring to FIG. 4, wherein like reference numbers refer to like components from FIGS. 1-3, tool 10A defines a vertical peripheral surface 144 characterized by fins 112. The fins 112 are spaced apart from one another to form channels 116 therebetween. The channels 116 are machined into the peripheral surface 144 to form the fins 112. Thus, the fins 112 protrude from the base surface 146 of the channels 116, but do not protrude from the original peripheral surface. Accordingly, insulating member 148 is not characterized by a cavity to accommodate the fins 112.

Figure 5:
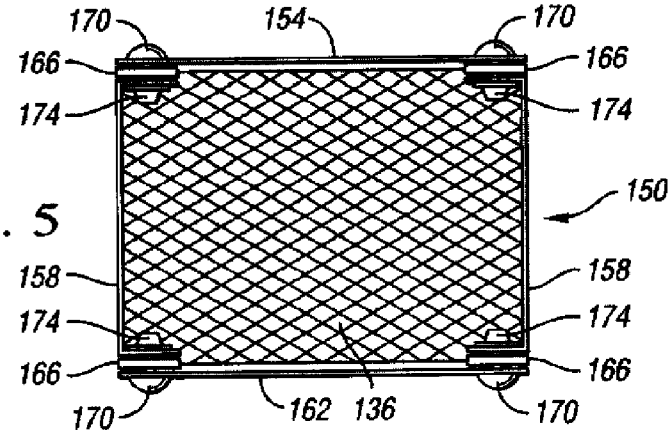
FIG. 5 is a schematic, cross-sectional side view of an insulating member for use with the metal forming tool of FIG. 4.

Referring to FIG. 5, exemplary construction for an insulating member 150 is schematically depicted. The construction of member 150 may be representative of the construction of members 108A-D of FIG. 1 and member 148 of FIG. 4. Member 150 includes enclosures formed of stainless steel plates surrounding an inner core of non-load bearing insulation 136. In a preferred embodiment, the enclosures include an inner cover 154, surrounds 158, and an outer cover 162. The surrounds 158 include double flanges for enclosing the insulation 136. Non-heat conductive separators 166, such as woven glass tape, separate the surrounds 158 from the inner cover 154. Again, the surrounds 158 are separated from the outer cover 162 by non-heat conductive separaters 166. In this manner, the inner and outer covers are thermally isolated from the rest of the enclosure such that heat transfer between the various components is minimized. The covers 154 and 162, in a preferred embodiment, are attached with machine screws 170 which are passed through slotted holes and attached to a nut 174 such that they allow for relative motion between the various components of the enclosure.

While the best modes for carrying out the invention have been described in detail, those familiar with the art to which this invention relates will recognize various alternative designs and embodiments for practicing the invention within the scope of the appended claims.

The invention claimed is:

1. A metal forming apparatus comprising:

a forming tool including a first portion defining a forming surface and a second portion defining a gas pressure chamber; and a plurality of fins in conductive heat transfer relationship with the forming tool.

2. The metal forming apparatus of claim 1, further comprising a member being releasably mounted with respect to the forming tool and cooperating with the forming tool to at least partially enclose the fins.

3. The metal forming apparatus of claim 2, further comprising at least one seal cooperating with the forming tool and the member to at least partially enclose the fins.

4. The metal forming apparatus of claim 2, wherein said plurality of fins are characterized by a first thermal conductivity; and wherein the member includes material having a second thermal conductivity lower than said first thermal conductivity.

5. The metal forming apparatus of claim 2, further comprising at least one fastening element releasably fastening the member with respect to the forming tool.

6. The metal forming apparatus of claim 2, wherein said plurality of fins are fully enclosed.

7. The metal forming apparatus of claim 2, wherein said plurality of fins are oriented vertically.

8. The metal forming apparatus of claim 1, further comprising at least one heating element configured to selectively heat the forming tool.

9. The metal forming apparatus of claim 8, wherein the forming tool defines a hole; and wherein said at least one heating element is at least partially in the hole.

10. The metal forming apparatus of claim 9, wherein said at least one heating element is an electrical resistance heating element.

11. A method comprising:

providing a metal forming tool having a plurality of fins operatively connected thereto;

providing a restriction to fluid flow across the fins;

heating the forming tool; and subsequent to said heating the forming tool, removing the restriction to fluid flow across the fins.

12. The method of claim 11, wherein said restriction is a member that at least partially encloses the fins.

13. The method of claim 11, further comprising, subsequent to said removing the restriction to fluid flow across the fins, forcing fluid across the fins.

14. A metal forming apparatus comprising:

a forming tool including a first portion defining a forming surface and a second portion defining a cavity for a working gas, said forming tool defining a hole;

a plurality of fins in conductive heat transfer relationship with the forming tool;

a member being releasably mounted with respect to the forming tool and cooperating with the forming tool to at least partially enclose the fins; and at least one heating element being at least partially within the hole.

* * * * *